US005321856A

United States Patent [19]

Gastesi

[11] Patent Number: 5,321,856

[45] Date of Patent: Jun. 21, 1994

[54] FLUSH TOILET EXHAUST SYSTEM

[76] Inventor: Ignacio Gastesi, Rt. 1 591 Y, Scottsville, Va. 24590

[21] Appl. No.: 129,353

[22] Filed: Sep. 30, 1993

[51] Int. Cl.[5] ..... E03D 9/05

[52] U.S. Cl. ..... 4/213; 4/216; 4/348

[58] Field of Search ..... 4/213, 216, 217, 218, 4/111.1, 306, 347, 472, 477, 482, 214

[56] References Cited

U.S. PATENT DOCUMENTS

| | | | |
|---|---|---|---|
| 3,495,282 | 2/1970 | Taggart | 4/213 |
| 4,103,370 | 8/1978 | Arnold | 4/216 |
| 4,165,544 | 8/1979 | Barry | 4/216 |
| 4,232,406 | 11/1980 | Beeghly et al. | 4/213 |
| 5,029,346 | 7/1991 | Fernald, Sr. | 4/216 |
| 5,054,130 | 10/1991 | Wilson | 4/213 |
| 5,199,111 | 4/1993 | Antepenko | 4/213 |

*Primary Examiner*—Henry J. Recla
*Assistant Examiner*—Gregory Vidovich

[57] ABSTRACT

An exhaust fixture adapted to be connected to a toilet, the toilet having a bowl, a water tank having a normal amount of water therein and an upper, peripheral edge, an overflow pipe located within the tank, and a lid adapted to fit about the peripheral edge of the tank; the exhaust fixture comprising a flexible hose for the passage of air therethrough, the flexible hose having first and second ends and a length proximate the perimeter of the peripheral edge of the tank, the flexible hose adapted to be configured about the peripheral edge of the tank and having a sealing member for sealing the flexible hose about the peripheral edge and a hose connection having an inlet for connecting and allowing air communication between the ends of the flexible hose and an outlet, the hose connection adapted to be configured about an upper edge of the tank and having a sealing member for sealing the hose connection about the upper edge, the exhaust fixture further adapted to be configured to receive the lid such that the flexible hose and hose connection are disposed between the lid and the tank forming a substantially air-tight gasket therebetween, the exhaust fixture further including air flow passages for allowing air communication from the tank interior and the exhaust fixture, and a blower connected to the outlet for the withdrawal of gases from air space above the normal water level in the tank.

7 Claims, 3 Drawing Sheets

FIG. 3
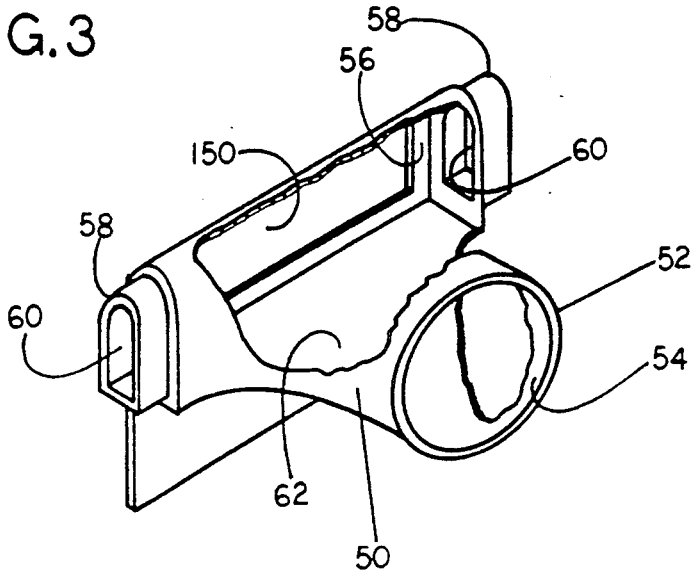
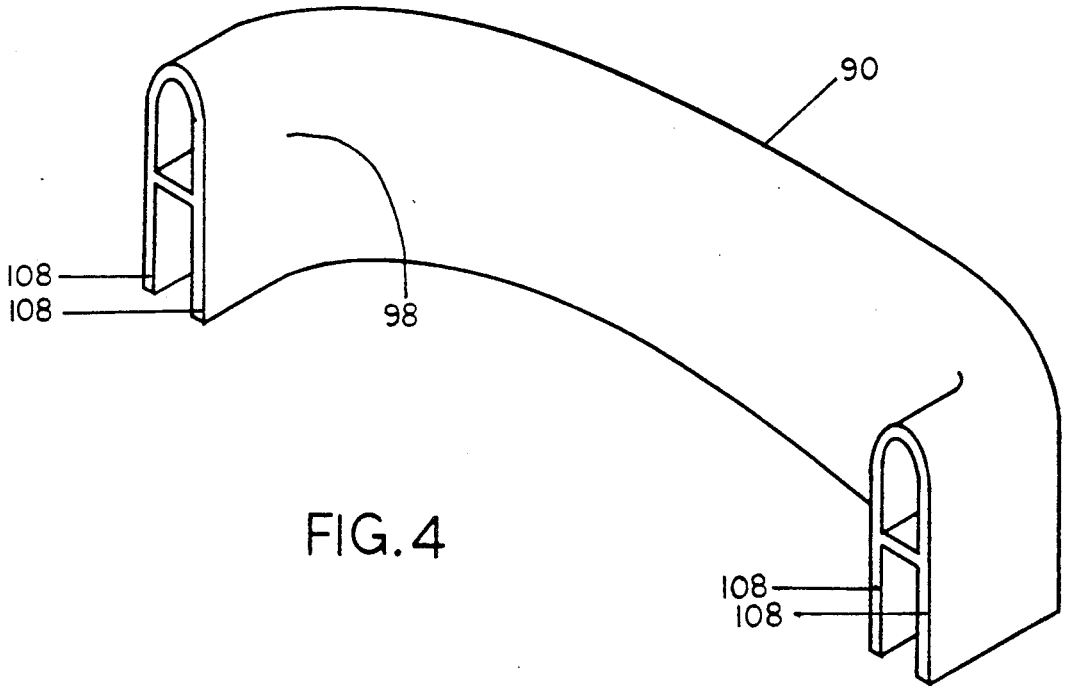
FIG. 4

FLUSH TOILET EXHAUST SYSTEM

FIELD OF THE INVENTION

This invention relates to systems that ventilate a toilet bowl by extracting air from the bowl through the flush tank and out to a remote point, and more particularly to a simple device adapted for easy mounting on a large variety of existing flush tank designs.

BACKGROUND OF THE INVENTION

Ventilating water closets by driving air from the bowl through the flush rim has long been recognized as a very efficient method for odor removal but are still not coming to a wide spread use. Some systems which withdrawal this air from the standpipe in a toilet tank and above the level of water in the water tank and are adapted for installation on existing toilets are disclosed in U.S. Pat. Nos. 3,703,010, 3,763,505, 4,165,544, 4,232,406, 4,582,250, and 5,029,346. The systems disclosed in U.S. Pat. Nos. 4,044,408 and 5,029,346 resolve the problems of water vapor intrusion. Some vapor intrusion. Some systems which resolve the problem of undesirable suction when the toilet is flushed are disclosed in U.S. Pat. Nos. 3,703,010, 4,165,544, 4,582,250, and 5,029,346.

The methods disclosed in the patents have the major disadvantage of not being adapted for easy mounting and that a particular element is only adapted to a particular water tank design. This creates the need to manufacture a large variety of different shapes to cover a large variety of existing water tank designs.

SUMMARY OF THE INVENTION

It is an object of the present invention to provide an inexpensive and easy to manufacture toilet odor removing apparatus that mounts easily on a large variety of existing toilet designs and toilet installations.

It is still a further object of the present invention to provide an apparatus that permits existing bathroom ventilation systems to be connected directly to the toilet.

It is still a further object of the present invention to provide an apparatus for toilet odor removal that is not located on the toilet bowl and, consequently, is not required to be periodically cleaned and does not interfere with the cleaning operations.

The instant invention relates to systems for venting odors from toilets having a bowl with a plurality of openings disposed about its rim, a water tank with an overflow pipe in air communication with the air space above the level of the water in the water tank and a lid for the water tank.

The device is an exhaust fixture that can be installed on a wide variety of toilet designs. It is mounted on the upper edge of the water tank forming, at the same time, a gasket for the lid.

The device is comprised of:

A hose connector in air communication with the air space of the interior of the water tank and the atmosphere exterior of the water tank.

A vent device allowing the venting of the water tank when it is flushed. The vent device comprises a housing having an opening which is submerged under the normal water level of the water tank and an interior chamber within the housing in fluid communication between the submerged opening and the athmosphere exterior of the water tank.

A sealing means connected together with the hose connector and the vent device, and preferably being a hollow strip including holes facing the interior of the water tank and along its length, and which installation comprises: adapting its length and shape to the upper edge of the water tank, by cutting and fitting to the space in between the hose connector and the vent device and then attaching the pieces, either by press fit or glue, to form altogether a closed loop and a gasket for the lid.

The hose connector, the vent device and the sealing means can be completely tied together. But for reasons of adaptability, it is preferred not to close the loop until installation.

Other objects, features and advantages will become apparent in the following specifications and detailed description of the invention.

BRIEF DESCRIPTION OF THE DRAWINGS

FIG. 3 is a perspective view of an alternative hose connector being broken away to show the opening, facing the interior of the water tank.

FIG. 4 is a perspective view of an alternative sealing means.

DETAILED DESCRIPTION OF THE INVENTION

Figure 1:
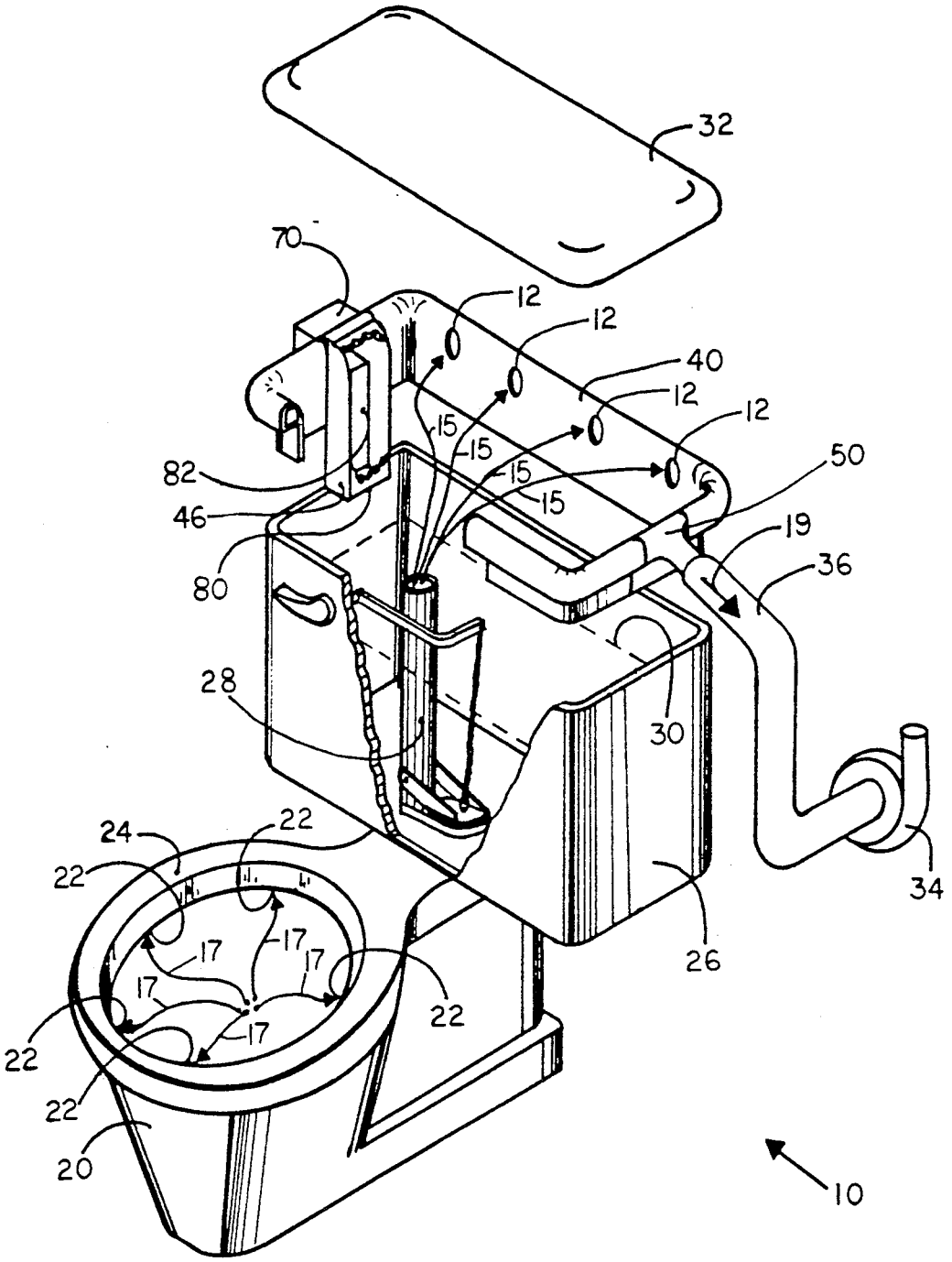
FIG. 1 is a perspective view of the preferred embodiment of the device having the conventional toilet and the gasket device broken away to show the path of the air flow.

FIG. 1 illustrates a preferred embodiment of the present invention. Number 10 generally designates a conventional toilet that includes a toilet bowl 20 with a plurality of openings 22 disposed about its rim 24. A water tank 26 with an overflow pipe 28 in air communication with the air space above the level of the water 30 in the water tank 26 and the openings 22 disposed on the rim 24 and a lid 32 for the water tank 26.

The exhaust fixture 40 of the device is positioned between the water tank 26 and the lid 32 sealing the space in between to increase the efficiency of the blower action.

Generally designated blower 34 connected via the hose 36 to the hose connector 50 of the exhaust fixture 40 of the device, extracts air, indicated with arrow 19, from the air space above the level of the water 30, through the openings 12 of the exaust fixture 40 of the device, and indicated by arrows 15 and consequently from the toilet bowl 20 through the openings 22 disposed in the rim 24 and indicated by arrows 17 via the overflow pipe 28. From blower 34, the extracted air is directed to an area remote from the toilet.

On the preferred embodiment, a vent device 70 is part of the exhaust fixture 40 of the device and eliminates any vacuum and thereby any restriction of the normal flow of water from the water tank 26 to the toilet bowl 20 during the flushing operation. As the water level 30 in the water tank 26 drops, the opening 80 of the submerged end 46 of the vent device 70 becomes uncovered, so air can be drawn from the exterior of the water tank 26 via the hollow chamber 82 of the vent device 70 to the air space above the water level 30 on the water tank 26.

The placement of the hose connector 50 and the vent device 70 are not critical and may be placed to suit the convenience and needs of installation Having described the functions of the exaust fixture 40 of the device, the novel apparatus will now be described.

Figure 2:
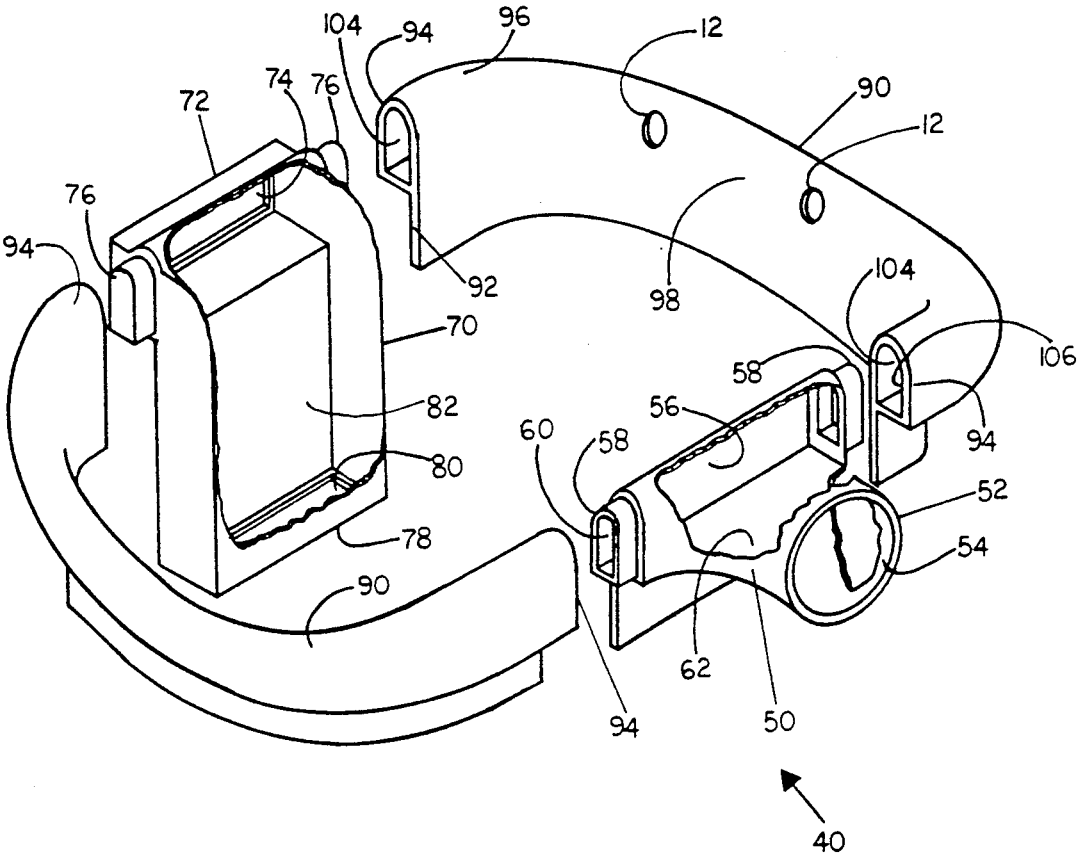
FIG. 2 is a exploded view of the preferred embodiment of the exhaust fixture of the present device.

FIG. 2 designates the prefered embodiment of the exhaust fixture 40 of the device. Apparatus 40 comprises a hose connector 50, a venting means 70 and a seal element 90.

The hose connector 50 includes an exterior edge 52 having opening 54 and prepared to be coupled to a hollow hose, an interior face 56, side edges 58 with openings 60 which are prepared to be coupled with side ends 94 of the seal element 90, and a hollow chamber 62 extending from exterior edge 52 to interior face 56 and side edges 58 and in communication with openings 54 and 60.

The venting means 70 includes an exterior edge 72 having opening 74, side edges 76 prepared to be coupled with side ends 94 of the seal element 90, and interior edge 78 having an opening 80 and a hollow chamber 82 extending from exterior edge 72 to interior edge 78 and in communication with openings 74 and 80.

The seal element 90 includes a bottom edge 92 adapted to seal and secure the position of the seal element 90, a top edge 96 adapted to seal against the lid, an interior edge 98 having at least one opening 12, and end edges 94 adapted to be coupled with side edges 58 of hose connector 50 and side edges 76 of venting means 70 and having openings 104 and a hollow chamber 106 extending from end edges 94 to the openings 12 on the interior edge 98.

FIG. 3 shows a hose connector 50 embodiing an opening 150 on the interior face 56, a hollow chamber 62 extending from exterior edge 52 to the interior face 56 and side edges 58 and in communication with openings 54, 150 and 60.

FIG. 4 shows a seal element 90 with bottom edges 108 extending down on both sides and without openings on the interior face 98.

The hose connector, the venting means and the seal element can be made out of resilient materials like plastic or rubber and with soft surfaces where the elements come in contact with the tank and the lid, for a better seal.

I claim:

1. An exhaust fixture adapted to be connected to a toilet, said toilet having a bowl with a rim, a water tank having a normal amount of water therein and an upper peripheral edge, an overflow pipe located within said water tank, and a lid adapted to fit about an upper, peripheral edge of said tank; the exhaust fixture comprising flexible hose means for the passage of air therethrough, said flexible hose means having first and second ends and a length proximate the perimeter of said upper, peripheral edge of said tank, said flexible hose means adapted to be configured about the upper, peripheral edge of said tank and having sealing means for sealing said flexible hose means about said upper peripheral edge and hose connection means having inlet means for connecting and for allowing air communication between said first and second ends of said flexible hose means and outlet means, said hose connection means adapted to be configured about an upper edge of said tank and having sealing means for sealing said hose connection means about said upper edge, said exhaust fixture further adapted to be configured to receive said lid such that said flexible hose means and hose connection means are disposed between said lid and said tank forming a substantially air-tight gasket therebetween, said exhaust fixture further including air flow means for allowing air communication from the tank interior and said exhaust fixture, and blower means connected to said outlet means for the withdrawal of gases from air space above said normal water level in said tank, said overflow pipe and consequently from said bowl through said exhaust fixture and said blower means to an area remote from the toilet.

2. The exhaust fixture of claim 1 wherein said hose connection means includes an anterior edge having said outlet means thereon and located exterior said tank after installation of said fixture.

3. The exhaust fixture of claim 2 wherein said hose connection means further includes an interior edge located within the interior of said tank after installation of said fixture, said interior edge having said air flow means located thereon allowing air communication from said tank interior and said exhaust fixture.

4. The exhaust fixture of claim 2 wherein said hose connection means further includes an interior edge located within the interior of said tank after installation of said fixture, said flexible hose means having an inner edge located within the interior of said tank after installation, said inner edge further having said air flow means thereon comprising at least one opening which allows air communication between said tank interior and said exhaust fixture.

5. The exhaust fixture of claim 1 wherein said sealing means for both of said flexible hose means and said hose connection means includes a bottom edge adapted to be mounted about said upper edge of said tank, an interior edge, located within the interior of said tank after installation of said fixture and extending from said bottom edge, adapted to be mounted to interior walls of said tank after installation of said fixture.

6. The exhaust fixture of claim 5 wherein said sealing means for both of said flexible hose means and said hose connection means includes an exterior edge, located exterior of said tank after installation of said fixture and extending from said bottom edge, adapted to be mounted to exterior walls of said tank after installation of said fixture.

7. The exhaust fixture of claim 1 further having venting means in connection with said exhaust fixture for the removal of air exterior of said tank, said venting means comprises a housing having an exterior edge having an opening thereon, said exterior edge located exterior of said tank after installation of said fixture and said opening on said exterior edge is in fluid communication with air exterior of said tank, said housing further having an interior edge having an opening thereon, said interior edge located within the interior of said tank, said opening on said interior edge adapted to be disposed below said normal water level in said tank, said venting means further including a hollow chamber therein in fluid communication with said openings in said exterior and interior edges, wherein, upon said withdrawal of gases and prior to flushing of said toilet, said exhaust fixture withdrawals gases from said tank interior, and after flushing, wherein a water level in the tank has gone below said normal water level and said opening on said interior edge, said exhaust fixture withdrawals gases from said tank interior and the air exterior of said tank.

* * * * *